United States Patent [19]

Raguet

[11] Patent Number: 4,859,929

[45] Date of Patent: Aug. 22, 1989

[54] CURRENT MIRROR HAVING A HIGH OUTPUT VOLTAGE

[75] Inventor: Philippe Raguet, Cormelles Le Royal, France

[73] Assignee: U.S. Philips Corporation, New York, N.Y.

[21] Appl. No.: 182,624

[22] Filed: Apr. 18, 1988

[30] Foreign Application Priority Data

May 22, 1987 [FR] France ..... 8707217

[51] Int. Cl.[4] ..... G05F 3/26

[52] U.S. Cl. ..... 323/316; 323/315

[58] Field of Search ..... 323/315, 316, 317

[56] References Cited

U.S. PATENT DOCUMENTS 4,081,696 3/1978 Oda et al. ..... 323/315

4,471,236 9/1984 Pattarson ..... 323/315

*Primary Examiner*—Patrick R. Salce

*Assistant Examiner*—Jeffrey Sterrett

*Attorney, Agent, or Firm*—Thomas A. Briody; Jack E. Haken; Jack D. Slobod

[57] ABSTRACT

A current mirror comprises a first branch in which a current to be duplicated (IE) flows and which comprises the main current path of a first transistor ($T_1$), and a second branch in which the output current (Is), which is a replica of the input current, flows and which comprises the main current path of a second transistor ($T_2$).

In order to obtain a higher maximum output voltage the main current path of a transistor is arranged in the second branch in series with that of the second transistor.

The bases of the first and second transistors are interconnected. A current $I_B$ is injected into the base of the series transistor and, if required, into the first branch. The current $I_B$ is suitably obtained by dividing a current $2I_B$ derived from the base current $I_B$ of the first and second transistors.

17 Claims, 2 Drawing Sheets

CURRENT MIRROR HAVING A HIGH OUTPUT VOLTAGE

BACKGROUND OF THE INVENTION

1. Field of the Invention

The invention relates to a current mirror comprising a first branch for receiving an input current to be reproduced, which first branch comprises the main current path of a first transistor of a first conductivity type, and a second branch for supplying an output current which is a replica of the input current, which second branch comprises the main current path of a second transistor of the first conductivity type, the bases of the first and the second transistor being interconnected, a third transistor of the first conuductivity type having its base and collector connected respectively to the collector and the base of the first transistor.

2. Description of the Prior Art

A current mirror of the type defined in the opening paragraph is known as a WIDLAR-type current mirror, in which the collector of the third transistor is connected to a power-supply source.

In an arrangement of this type the output voltage is limited to approximately $B_{VCEO}$, which is the value beyond which the second transistor operates in the avalanche-breakdown region.

SUMMARY OF THE INVENTION

It is the object of the invention to provide a current mirror which enables substantially higher output voltage to be obtained.

To this end it is characterized in that the second branch comprises the main current path of a fourth transistor of the first conductivity type in series with the main current path of the second transistor, and in that it comprises an auxiliary current mirror for injecting into the base of the fourth transistor a first injection current equal to half the current flowing in the collector of the third transistor.

In a preferred embodiment the auxiliary current mirror may comprise a fifth transistor of a second conductivity type opposite to the first conductivity type, having a first collector for supplying said first injection current and a second collector, constituted for example by two interconnected collector portions of the same surface area as the first collector, which second collector is connected to the base of the fifth transistor and to the collector of the third transistor.

In a first embodiment the current mirror supplies a second injection current of the same value as the first injection current, which second injection current is added to said input current in the first branch. The second injection current can be supplied by a third collector of the fifth transistor.

In a preferred second embodiment, which enables the occurrence of the Early effect in the second transistor to be minimized the first branch comprises the main current path of a sixth transistor of the first conductivity type between the emitter of the first transistor and the common mode terminal, which sixth transistor has its collector connected to the emitter of the first transistor and its emitter to the common-mode terminal, and the output branch comprises a diode poled in the forward direction and having one electrode connected to the common-mode terminal. The diode may be, for example, a diode-connected seventh transistor of the first conductivity type, whose base and collector are short-circuited and connected to the base of the sixth transistor and to the emitter of the second transistor, the emitter of the seventh transistor being connected to the common-mode terminal.

Suitably, for example by providing the fifth transistor with a fourth collector, the auxiliary current mirror is adapted to supply a third injection current which has the same value as the first one and which is added to the current supplied by the main-current path of the fourth transistor in the second branch.

In a third embodiment, by means of which higher voltages than in the two preceding cases can be obtained, the second branch comprises the main current path of an eighth transistor of the first conductivity type between the collector of the fourth transistor and the point where the output current is available, the auxiliary current mirror being adapted to inject a fourth injection current of the same value as the first injection current into the base of the eighth transistor, for example by the providing the fifth transistor with a fifth collector. The fifth transistor may also comprise a sixth collector supplying a fifth injection current which has the same value as the collector current of the third transistor and which in the first branch is added to said input current.

Embodiments of the invention will now be described in more detail, by way of example, with reference to the accompanying drawings, in which:

DETAILED DESCRIPTION OF THE PREFERRED EMBODIMENTS

Figure 1A:
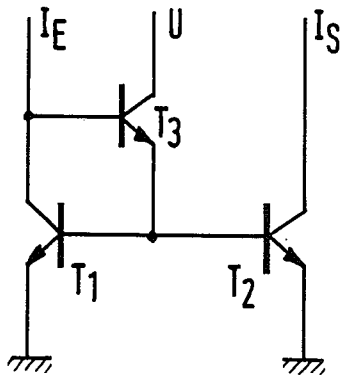
FIG.1a PRIOR ART
FIG. 1*a* shows a known current mirror of the WIDLAR type.

In FIG. 1*a* a current mirror of the WIDLAR type comprising an input branch which receives an input current $I_E$ and which comprises the main current path of a transistor $T_1$, and an output branch, in which an output current Is flows and which comprises the main current path of a transistor $T_2$. The base of the transistors $T_1$ and $T_2$ are interconnected. A transistor $T_3$ has its base connected to the point to which the current $I_E$ is applied and its main current path is arranged between a power-supply source U and the bases of the transistors $T_1$ and $T_2$. In the present case the transistors $T_1$, $T_2$ and $T_3$ are of the npn type, the emitters of $T_1$ and $T_2$ being connected to the common-mode (or ground) terminal and the emitter of $T_3$ being connected to the bases of $T_1$ and $T_2$. Since the base current of the transistor $T_3$ is negligible, the output current Is is equal to the input current $I_E$.

Figure 1B:
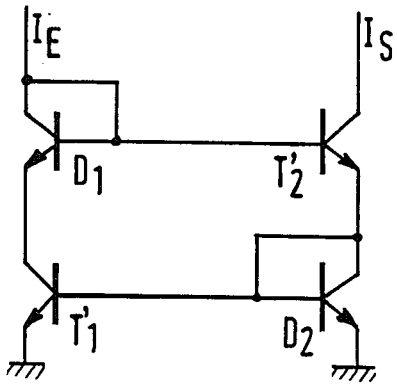
FIG.1b PRIOR ART
FIG. 1*b* shows a known current mirror of the WILSON type.

In FIG. 1*b* a current mirror of the WILSON type comprises an input branch, receiving an input current $I_E$ and comprising the main current path of a transistor $T'_1$, and an output branch, in which an output current $I_s$ flows and which comprises the main current path of a transistor $T'_2$.

Moreover, in series with the main current path of the transistor $T'_1$ the first branch comprises a diode $D_1$, which is poled in the forward direction and which is here represented as an npn-transistor whose base and collector are short-circuited and connected to the base of the transistor $T'_2$ and whose emitter is connected to the collector of the transistor $T'_1$, whose emitter is connected to the common-mode terminal.

In addition, the second branch comprises a diode $D_2$ in series with the main current path of the transistor $T'_2$, which diode is poled in the forward direction and which is here represented as an npn transistor whose base and collector are short-circuited and connected to the base of the transistor $T'_1$ and to the emitter of the transistor $T'_2$, and whose emitter is connected to the common-mode terminal.

$I_{B1}$ and $I_{B2}$ are the base currents of the transistors $T'_1$ and $T'_2$ respectively.

The current applied to the collector of $T'_1$ has the value $I_E$-$I_{B2}$, so that the current flowing in the emitter of $T'_1$ has the value $I_E-I_{B2}+I_{B1}$. As a result of the interconnection between the base of the transistor $T'_1$ and the anode of the diode $D_2$, the latter current is equal to that flowing in the diode $D_2$ if it is assumed that this diode is a diode-connected transistor of the same dimensions as the transistor $T_1'$.

The current, $I_s+I_{B2}$, which flows in the emitter of the transistor $T'_2$ consequently has the value $I_E-I_{B2}+2$ $I_{B1}$, so that:

$$I_s=I_E+2(I_{B1}-I_{B2})\approx I_E$$

However, the structure of the output branch limits the maximum output voltage which can be obtained on the collector of the transistor $T_2$ (FIG. 1*a*) or $T'_2$ (FIG. 1*b*) to a value of the order of magnitude of $B_{VCEO}+V_{BE}$, because when the collector-emitter voltage of $T_2$ reaches the value $B_{VCEO}$, which is the collector-emitter avalanche voltage, its operation is no longer linear and Is is then only an approximation to $I_E$.

For certain uses a reproduction accuracy of the order of a few % is desirable, which means that the arrangement must be redesigned.

The basic idea of the invention is to arrange the two main current paths of two transistors in series in the output branch in such a way that a substantially higher output voltage can be obtained, for example of the order of 2 $B_{VCEO}$, while preserving the reproduction accuracy of the input current $I_E$.

Figure 2:
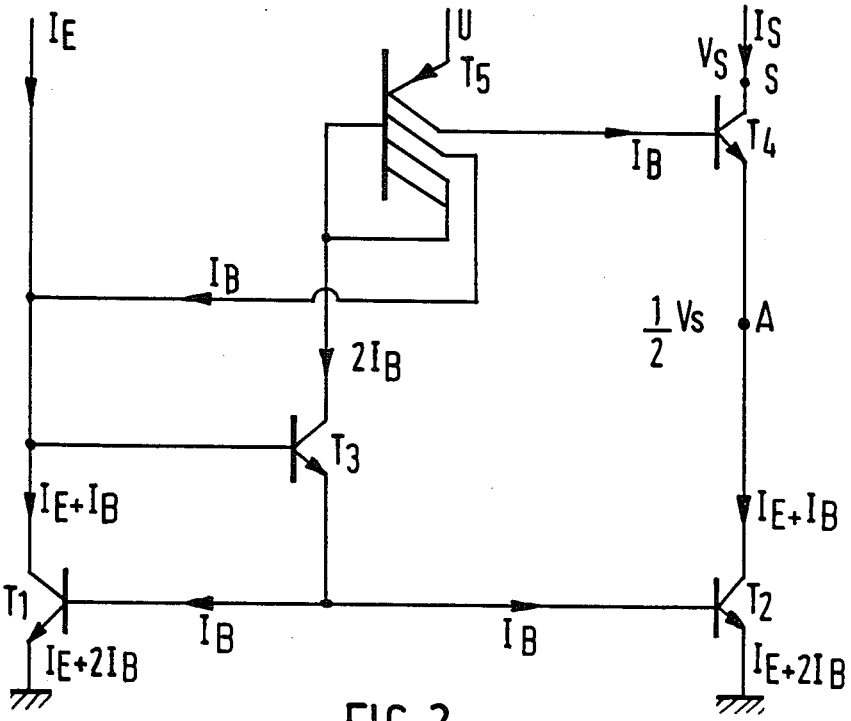
FIG. 2 shows a first embodiment of a current mirror in accordance with the invention.

In FIG. 2 the input branch receiving the input current $I_E$ comprises the main current path of a transistor $T_1$ whose emitter is connected to the common-mode terminal.

The main current paths of the transistors $T_2$ and $T_4$ are arranged in series in the output branch supplying the current $I_s$, the emitter of $T_4$ being connected to the collector of $T_2$ and the emitter of $T_2$ being connected to the common-mode terminal. Moreover, the bases of the transistors $T_1$ and $T_2$ are interconnected, as a result of which the two transistors have equal emitter currents.

In the two branches equal currents are obtained by injecting currents of the same value $I_B$ into the base of the transistor $T_4$ and into the first branch, so that the latter current is added to the input current $I_E$.

In the embodiment shown in FIG. 2 said currents are supplied by a multi-collector transistor $T_5$ having four collector outputs. One of these collector outputs is used for injecting a current $I_B$ into the input branch in such a way that it is added to the input current $I_E$ (enabling exact compensation to be obtained) and another collector output is used for injecting a current $I_B$ into the base of the transistor $T_4$. The remaining two collector outputs are interconnected and connected to the base of the transistor $T_5$, the resulting current $2I_B$ being due to equal halves contributed each of said remaining two collectors. Thus, the transistor $T_5$ constitutes an auxiliary current mirror. This current $2I_B$ is the collector current of a transistor $T_3$ having its emitter connected to the base of the transistors $T_1$ and $T_2$ and having its base connected to the collector of the transistor $T_1$. The emitter of the transistor $T_5$ receives a supply voltage U.

Since the transistors $T_4$ and $T_2$ have practically the same collector current, and their base current $I_B$ is the same, they will have substantially the same collector-emitter voltage.

Vs is the output voltage on the collector of the transistor (point S). The voltage $V_A$ on point A (the collector of $T_2$) is then substantially equal to $\frac{1}{2}$ Vs.

This division of the output voltage between the two transistors $T_2$ and $T_4$ enables the maximum output voltage to be substantially doubled relative to a single current mirror. A distinction can be made between two ranges of operation.

(1) $Vs < 2U-2\ V_{BE}$, $V_{BE}$ being a base-emitter voltage of a transistor (approximately 0.7 V). If $U<B_{VCEO}$, this yields $V_A=Vs/2<U-V_{BE}$ so that $V_A<B_{VCEO}$ In this range $T_2$ and $T_4$ both operate in their linear region. It is to be noted that since $V_A$ varies the transistor $T_2$ will exhibit a certain susceptibility to the Early effect.

(2) $2\ U-2\ V_{BE}<Vs<U+B_{VCBO}$

The transistor $T_5$ is bottomed and $V_A$ is stabilized at $U-V_{BE}$.

A current $I_B$ can reach the collector-base junction of the transistor $T_4$, which transistor will then begin to operate in the range $BV_{CB}$. This means that:

$$I_S=I_E+|I_B|$$

This current $I_B$ increases as $V_S$ increases. The limit value of Vs is $U+BV_{CBO}$ or the $BV_{CS}$ of the transistor $T_4$.

Example:

| | | |
|---|---|---|
| $BV_{CEO}$ = 27 V<br>$I_E$ = 100 μA | $BV_{CBO}$ = 67 V | $BV_{CS}$ = 80 V |

U=25 V; 1-kΩ resistors are arranged in the emitter lines of $T_1$ and $T_2$.

| Vs(V) | 1 | 5 | 10 | 20 | 30 | 50 | 60 | 70 | 79 |
|---|---|---|---|---|---|---|---|---|---|
| Is(μA) | 99.64 | 100.42 | 101.12 | 102.34 | 102.83 | 104.12 | 106.73 | 115.34 | 150 |

Figure 3:
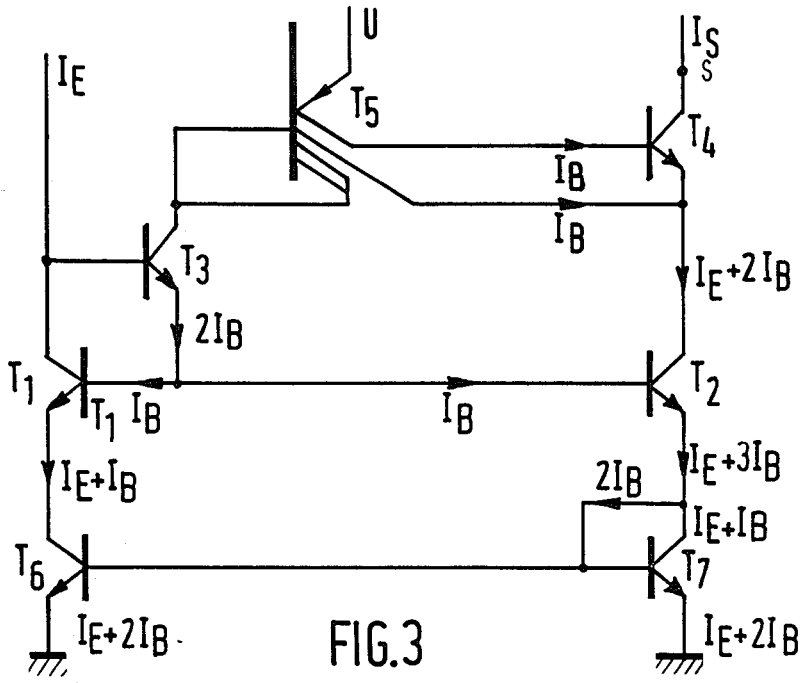
FIG. 3 shows a preferred embodiment of a current mirror in accordance with the invention, which mitigates the influence of the Early effect.

In FIG. 3 the transistors $T_1 \ldots T_5$ are arranged in the same way as in FIG. 2, except that the collector of the transistor $T_5$ which injects a current into the input branch has been dispensed with.

Between the emitter of the transistor $T_1$ and the common-mode terminal the input branch comprises the main current path of a transistor $T_6$, whose collector is connected to the emitter of the transistor $T_1$ and whose emitter is connected to the common-mode terminal.

The output branch comprises a diode-connected transistor $T_7$ which has its base and its collector shortcircuited and connected to the base of the transistor $T_6$ and to the emitter of the transistor $T_2$. The emitter of the transistor $T_7$ is connected to the common-mode terminal. This means that: $Is=I_E+I_B$ (equal currents in the transistors $T_6$ and $T_7$) with $Vs \geqq 2\ B_{BE} \approx 1.5$ V.

This means that the susceptibility to the Early effect is reduced.

Example:

$U=25$ V, $I_E=100\ \mu A$ $BV_{CEO}$, $BV_{CBO}$, $B_{VCS}$ have the same values as in the foregoing example.

| Vs(V) | 1.5 | 5 | 10 | 20 | 30 | 50 | 60 | 70 | 81 |
|---|---|---|---|---|---|---|---|---|---|
| Is(μA) | 99.81 | 100.04 | 100.13 | 100.39 | 100.66 | 101.88 | 104.47 | 112.87 | 150 |

The accuracy is very high from 1.5 V to 50 V and subsequently degrades rapidly.

Figure 4:
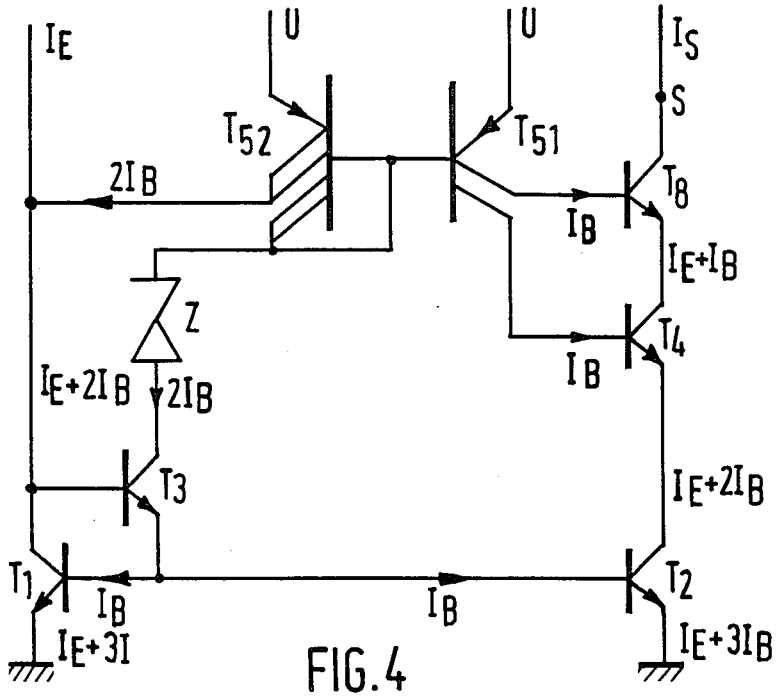
FIG. 4 shows a third embodiment of the invention having a very high output voltage.

In FIG. 4 the output branch comprises, in this order, the main current paths of the transistors $T_8$, $T_4$ and $T_2$ in series with the point S supplying the output current Is. To simplify the drawing, the transistor $T_5$ is represented as two transistors $T_{51}$ and $T_{52}$ having their bases interconnected and having their emitters connected to the power-supply source U. The transistor $T_{51}$ has two collectors connected to the respective bases of the transistors $T_8$ and $T_4$. The transistor $T_{52}$ has four collectors of the same surface area interconnected pairwise (or two collectors of twice the surface area of those of the transistor $T_{51}$). Two of said interconnected collectors are connected to the point of the input branch which receives the current $I_E$, in such a way that their current is added to said input current. The two other interconnected collectors are connected to the base of the transistor $T_{52}$ and to the collector of the transistor $T_3$, if desired via a Zener diode which is poled in the reverse direction and whose Zener voltage is suitably higher than $U\text{-}BV_{CEO}(T_3)$, in order to minimise the risk of breakdown. A current $I_B$ flows in the bases of the transistors $T_1$ and $T_2$ so that a current $2I_B$ flows in the collector of the transistor $T_3$ if the base current of this transistor is ignored. The transistors $T_{51}$ and $T_{52}$, which constitute a current mirror similar to that comprising the transistor $T_5$, supplies a current $2I_B$ to the input branch and a current $I_B$ to the base of each of the transistors $T_8$ and $T_4$. A current $I_E+3I_B$ flows in the emitters of $T_1$ and $T_2$, a current $I_B+2I_B$ in the emitter of $T_4$, and a current $I_E+I_B$ in the emitter of $T_8$, so that Is is a replica of the input current $I_E$.

If $U=2BV_{CEO}$ the voltage $V_s$ can reach a value of approximately 3 $BV_{CEO}$, i.e. approximately 80 V if the values of the preceding examples are adopted.

What is claimed is:

1. A current mirror comprising a first branch for receiving an input current to be reproduced, which first branch comprises a main current path of a first transistor of a first conductivity type, and a second branch for supplying an output current which is a replica of the input current, which second branch comprises a main current path of a second transistor of the first conductivity type, bases of the first and the second transistor being interconnected, a third transistor of the first conductivity type having its base and emitter connected respectively to a collector and a base of the first transistor, characterized in that the second branch comprises a main current path of a fourth transistor of the first conductivity type in series with the main current path of the second transistor and in that it comprises an auxiliary current mirror for injecting into the base of the fourth transistor a first injection current equal to half the current flowing in the collector of the third transistor.

2. A current mirror as claimed in claim 1, characterized in that the auxiliary current mirror comprises a fifth transistor of a second conductivity type 1 opposite to the first conductivity type, having a first collector for supplying said first injection current and a second collector connected to a base of the fifth transistor and to the collector of the third transistor.

3. A current mirror as claimed in claim 2, characterized in that the second collector of the fifth transistor comprises two interconnected collector portions of the same surface area as the first collector.

4. A current mirror as claimed in claim 2, characterized in that the auxiliary current mirror is adapted to supply a second injection current of the same value as the first injection current, which second injection current is added to said input current in the first branch.

5. A current mirror as claimed in claim 4, characterized in that the fifth transistor has a third collector for supplying the second injection current.

6. A current mirror as claimed in claim 2, characterized in that the first branch comprises a main current path of a sixth transistor of the first conductivity type connected between the emitter of the first transistor and a common-mode terminal, which sixth transistor has its collector connected to the emitter of the first transistor and its emitter to the common-mode terminal, and in that the second output branch comprises a diode poled in the forward direction, which diode has one electrode connected to the common-mode terminal and its other electrode to an emitter of the second transistor and to the base of the sixth transistor.

7. A current mirror as claimed in claim 6, characterized in that said diode comprises a seventh transistor of the first conductivity type having its base and collector short-circuited and connected to the base of the sixth transistor and to the emitter of the second transistor, the emitter of the seventh transistor being connected to the common-mode terminal.

8. A current mirror as claimed in claim 6, characterized in that the auxiliary current mirror is adapted to supply a third injection current which has the same value as the first one and which is added to the current supplied by the main-current path of the fourth transistor in the second branch.

9. A current mirror as claimed in claim 8, characterized in that the fifth transistor has a fourth collector for supplying said third injection current.

10. A current mirror as claimed in claim 2, characterized in that said second branch comprises the main current path of a sixth transistor of the first conductivity type connected between a collector of the fourth transistor and a point for supplying the output current, and in that the auxiliary current mirror is adapted to inject a second injection current of the same value as the first injection current into a base of the sixth transistor.

11. A current mirror as claimed in claim 10, characterized in that the auxiliary current mirror is adapted to supply a third injection current of the same value as the collector current of the third transistor, said third injection current being added to said input current in the first branch.

12. A current mirror as claimed in claim 10, characterized in that the fifth transistor has a third collector for supplying the second injection current.

13. A current mirror as claimed in claim 12, characterized in that the fifth transistor has a third collector for supplying the third injection current.

14. A current mirror as claimed in claim 13, characterized in that the third collector comprises two interconnected collector portions having the same surface area as that of the second collector.

15. A current mirror as claimed in claim 10 further comprising a Zener diode which is poled in the reverse direction and connected in a collector line of the third transistor, said Zener diode having a Zener voltage which is at least equal to the supply voltage minus the avalanche voltage of a transistor.

16. A current mirror as claimed in claim 1, characterized in that the auxiliary current mirror is adapted to supply a second injection current of the same value as the first injection current, which second injection current is added to said input current in the first branch.

17. A current mirror as claimed in claim 1, characterized in that said second branch comprises the main current path of a sixth transistor of the first conductivity type connected between a collector of the fourth transistor and a point for supplying the output current, and in that the auxiliary current mirror is adapted to inject a second injection current of the same value as the first injection current into a base of the sixth transistor.

* * * * *